US005645005A

United States Patent [19]

Golland

[11] Patent Number: 5,645,005

[45] Date of Patent: Jul. 8, 1997

[54] SPRING LINE FOR MARINE VESSEL AND METHOD OF USE

[76] Inventor: Stanley Golland, 1231 SW. 87th Terr., Plantation, Fla. 33324

[21] Appl. No.: 583,949

[22] Filed: Jan. 11, 1996

[51] Int. Cl.[6] ..... B63B 21/00

[52] U.S. Cl. ..... 114/230

[58] Field of Search ..... 114/230, 221 R, 114/293, 218

[56] References Cited

U.S. PATENT DOCUMENTS

| | | | |
|---|---|---|---|
| 2,561,487 | 7/1951 | Bailhe | 114/230 |
| 2,811,127 | 10/1957 | Palsson | 114/230 |
| 3,094,755 | 6/1963 | Casanave | 114/230 |
| 4,597,351 | 7/1986 | Brainard | 114/230 |
| 4,656,961 | 4/1987 | Hellkamp | 114/230 |
| 4,864,956 | 9/1989 | Onstwedder | 114/230 |

OTHER PUBLICATIONS

Defender Catalog, Defender Industries, Inc., New Rochelle, NY, p. 40.

*Primary Examiner*—Stephen Avila

*Attorney, Agent, or Firm*—Malin, Haley, DiMaggio & Crosby

[57] ABSTRACT

A spring line for a marine vessel for securing the mid portion of a vessel to a pier having a cleat or post that includes a continuous line having first and second free ends and a substantially centrally located loop, wherein the loop is cleated to a single cleat along the midships of the vessel and each free end of the line is sufficiently long enough for cleating to cleats on the pier. The invention eliminates the necessity of two separate spring lines, greatly reducing costs and reducing operator input necessary for securing or unsecuring the vessel. The centrally disposed loop in the line is integrally formed with the entire loop and woven integrally therewith for strength.

6 Claims, 2 Drawing Sheets

SPRING LINE FOR MARINE VESSEL AND METHOD OF USE

BACKGROUND OF TEE INVENTION

1. Field of the Invention

This invention relates generally to mooring lines used to tie a boat or ship to a pier post or dock and specifically, to improved spring line for a marine vessel that eliminates the need for two separate spring lines for mooring a vessel to a pier, dock, or other mooring point.

2. Description of the Prior Art

The use of ropes and lines, both lightweight and heavy duty, for securely tieing a small boat or large ship to a pier, dock, or mooring environment have been well known for centuries. For vessels larger than 20 ft., normally the vessel would be tied to a pier with cleats and lines that would include a bow line, a stern line, and a pair of spring lines, after spring line and fore spring line respectively, which are secured near the midships by cleats and are typically criss-crossed. One of the important functions of ropes or lines for mooring a boat securely to a dock is to be flexible or resilient enough to allow for movement of the vessel based on tides or waves without snapping the lines, while at the same time keeping the boat securely affixed against the pier or dock, which typically has fenders for separating the vessel from the pier or dock.

Typically, the pier or dock has posts or cleats which affix one end of the line or rope securely to the dock, while the opposite end of the rope is secured to a cleat on the boat, again typically at the bow, the stern, and a pair of cleats amidship for the spring lines.

The purpose of spring lines is to keep the position of the ship or boat against the fenders along the mid-portions of the boat, while permitting vertical movement of the ship by having sufficient slack to allow the ship to rise or fall based on tides or wave action. The use of two separate spring lines requires two separate activities for fastening each end of the spring line to the boat and criss-crossing the spring line, typically during that action.

The present invention provides for the use of a single spring line having three connection points, one each at the free end of the line, and a substantially centrally located loop, integrally formed with the entire line, that allows the spring line to be affixed to a single cleat on the boat and to a pair of cleats on the pier, securely fastening the boat to the pier.

U.S. Pat. No. 1,591,105 shows a tow line used to tow vehicles that includes three segments of line having loops in each and that are quite structurally different than the present invention. The present invention has a single line, rope, or similar construction that is substantially elongated and has an integrally connected loop in a central portion that is sized for sufficient connection to a cleat or post affixed to a boat to provide for double spring line action with a single rope.

SUMMARY OF THE INVENTION

A spring line for tieing and securing a boat or ship to posts or cleats, comprising an elongated rope, sized appropriately in diameter for securing a vessel of certain size and weight, said elongated line being of sufficient length and having first and second free ends, said line including an integrally formed loop woven therein, substantially dividing the line into two fairly equal lengths, said line loop being sized in diameter approximately greater than ten (10) inches, a sufficiently long loop for being attached to a cleat.

The improved spring line may also have loops at said first and second free ends, sized in diameter to fit appropriately around the size cleats on a dock or pier, or, in the alternative the free ends could be tied around a post or posts on a pier.

The spring line is used typically by fastening or affixing the rope loop near its central portion about a cleat attached to the boat and spreading the free ends of the line to separated cleats on the dock where they are affixed in place. Sufficient slack is presented in the line to allow for movement of the boat, depending on the particular tides and height and depth that the boat will move while it is tied up.

The spring line itself can be made of a material used for conventional ropes and lines used in the marine environment, both of natural and artificial fibrous materials that are woven together in various rope diameters that make it suitable for use with boat or ship cleats found on conventional docks and cleats found on conventional boats.

The diameter thickness of the spring line can be varied to accomplish a range of different sized vessels with heavier vessels necessarily requiring stronger and larger diameter lines.

In the overall construction of the invention, the loop would be woven into the elongated length of rope or line near its central position so that it is formed integrally, forming a single line woven together for insuring strength so that the loop cannot separate from the line itself.

By way of example, the rope can vary between ⅜ inches thickness in diameter to ½ inches in diameter, and the loop size can vary from 10 or 12 inches in diameter, enough for the boat cleat.

The primary advantage of the present invention is that it eliminates the use of two separate lines for spring lines and two separate connections at each end for the spring lines. A second advantage of the present invention is that it is easier, especially for a single person, to tie the boat up or release the lines when getting underway, since there is only a single connection on the ship or boat at one cleat. Another advantage of the present invention is that there is less line required for storage so that the improved spring line can take up less room in storage which, with large vessels having large diameter lines, can substantially reduce the volume required for storage.

It is an object of this invention to provide an improved spring line for use with a boat or ship in a marine environment for securing the boat or ship to a pier or dock.

It is another object of this invention to provide an improved marine spring line which eliminates the use of double spring lines with a single line for securing a boat or ship to a pier.

And yet still another object of this invention is to provide an improved line that has first and second free ends and has integrally formed therein a secured loop made of the same line materials and of the same diameter for securing objects from the loop to the free ends.

Yet another object of the present invention is to provide a an improved marine spring line for securing a vessel to a pier or dock while requiring substantially less line than conventional dual line rigs.

In accordance with these and other objects which will become apparent hereinafter, the instant invention will now be described with particular reference to the accompanying drawings.

DESCRIPTION OF THE PREFERRED EMBODIMENTS

Figure 3:
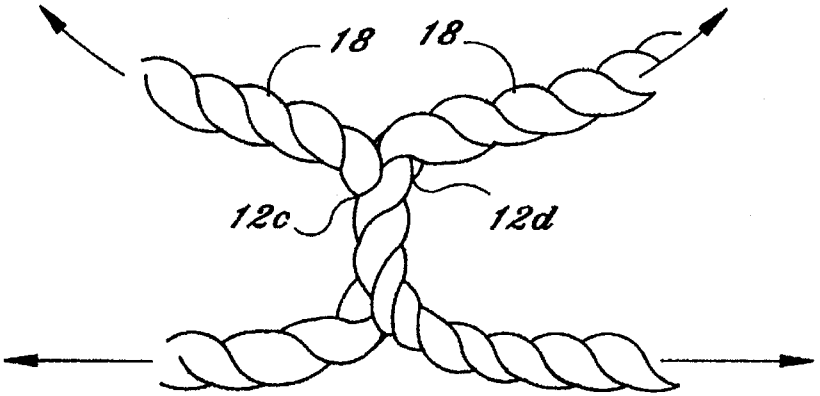
FIG. 3 shows a cut away portion of the line and loop interaction and interweaving structure, where the loop is affixed to the rope in accordance with the present invention.
Figure 1:
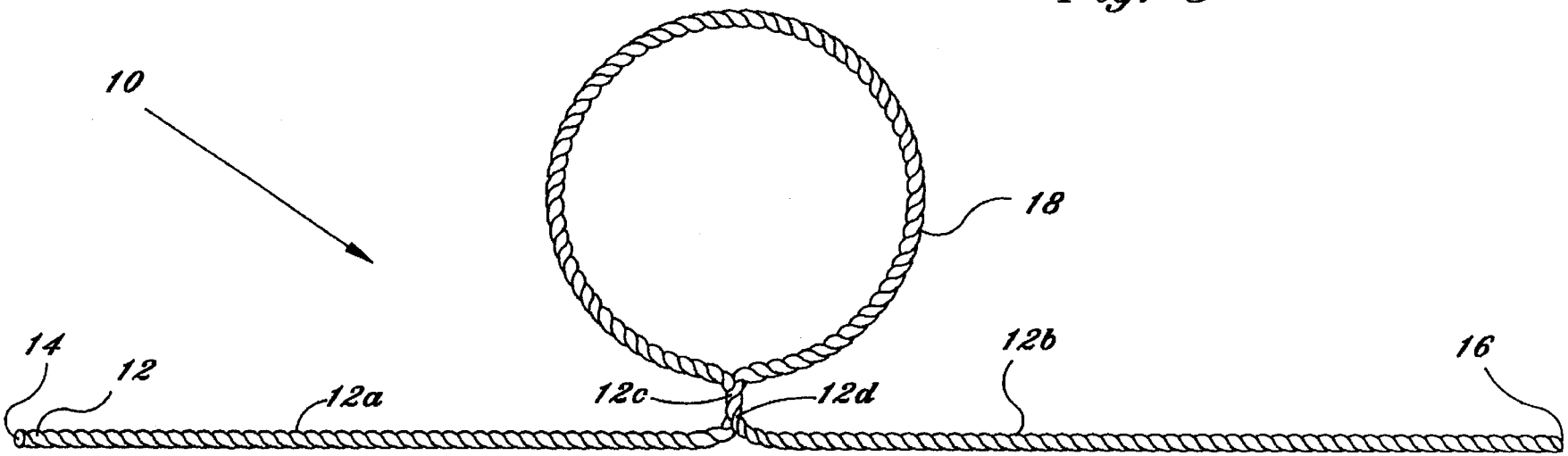
FIG. 1 shows a perspective view of an improved spring line in accordance with the present invention.

Referring now to the drawings and in particular FIG. 1, the present invention is shown generally at 10 as an improved spring line comprised of a line or rope 12 having a first, flexible, elongated segment 12*a* with a free end 14, a second, flexible, elongated segment 12*b* with free end 16, and a center integrally formed loop 18 that is part of line 12. Loop 18 defines a loop diameter of approximately 10 to 12 inches that is interwoven at junctures 12*c* and 12*d*.

In a preferred embodiment, line 12 is comprised of strandtwisted nylon. The loop 18 is overbraided integrally into the entire line segment, forming a unitary body of spring line 12. The sizes for the line may be ⅜ inches in diameter up to ⅝ inches in diameter with a 10 or 12 inch loop diameter, and having a total, end-to-end length from 30 feet to 55 feet. The selection of line diameter and length will be a function of practical utilization of the invention.

Figure 2:
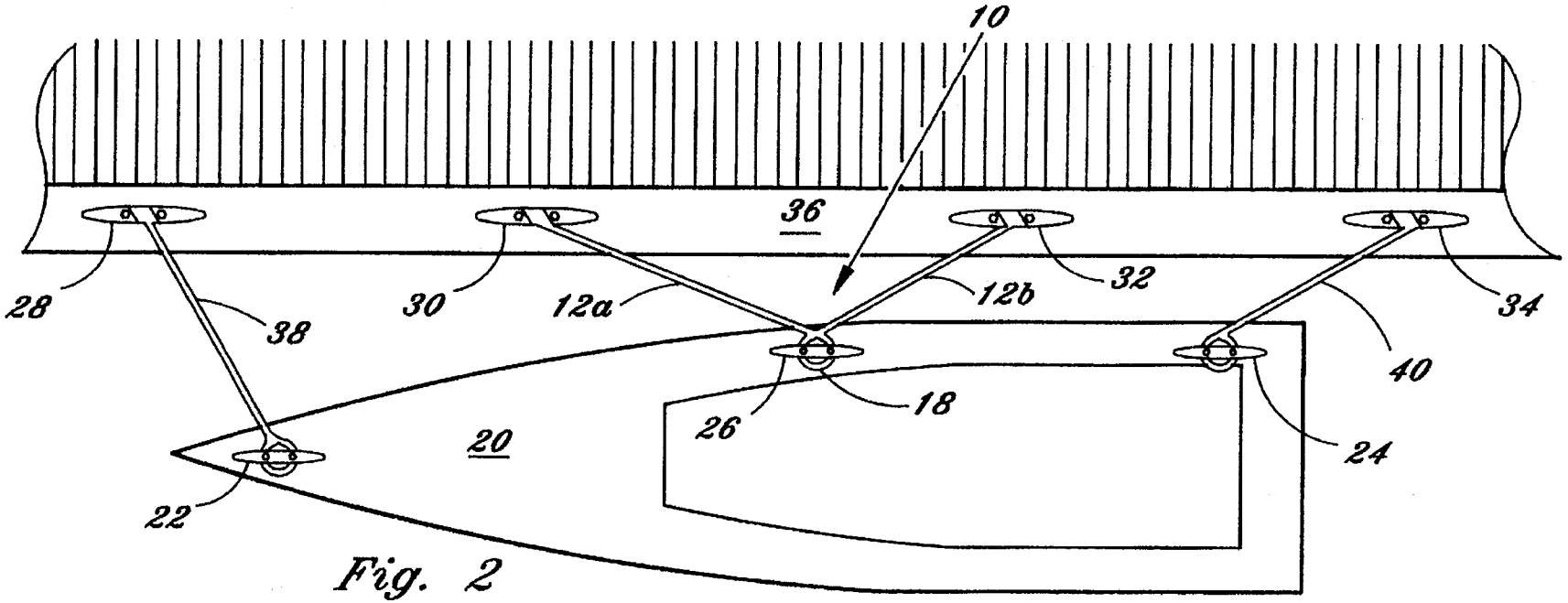
FIG. 2 shows a schematic diagram, representative of the use of the present invention with a ship in a top plan view.

FIG. 2 shows a schematic diagram using the improved spring line 10 with a boat 20 that has conventional cleats, such as bow cleat 22, stern cleat 24, and a cleat amidships 26 along the starboard side of the vessel.

The pier or dock includes cleat 28, cleat 30, cleat 32, and cleat 34, which are rigidly attached to a pier or dock 36.

The boat 20 is secured to the pier 36 by a bow line 38 attached between cleat 28 affixed to the pier 36 and the bow cleat 22. The stern of boat 20 is connected by cleat 34 secured to pier 36 and cleat 24, by stern line 40. The bow line 38 and the stern line 40 are conventionally connected, securing the bow and stern movement of the boat 20.

Applicant's improved spring line 10 is shown cleated to boat 20 through loop 18 connected to cleat 26 amidships of boat 20, with each free end of the improved spring line 10 having sections 12*a* and 12*b* connected to cleats 30 and 32, respectively. Spring lines conventionally prevent forward and aft movement of a boat, which is the case here, such that spring line 12*b* prevents forward movement of the boat or bow, while spring line 12*a* prevents aft movement of the boat, while still providing enough slack to allow for rising and lowering tides. By providing a single spring line 10, with the free ends cleated properly and the loop cleated to the boat, the use of two separate, independent spring lines is alleviated.

To insure proper strength of loop 18 that is integrally formed and woven into the line 12, the junction of loop 18 at junction points 12*c* and 12*d* diagrammatically represent that they are woven into and around the strand-twisted nylon throughout, forming an extremely strong structure, where the loop cannot separate from the rest of the line 12, either segments 12*a* or 12*b* that are formed as one integral unit.

Figure 4:
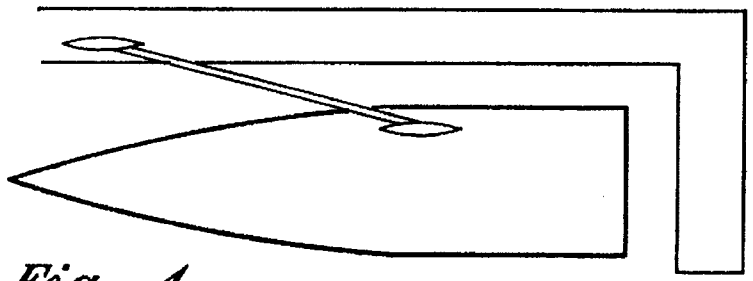
FIG. 4 shows a schematic diagram, representative of an alternate use of the present invention as a forward spring line, with a ship in top plan view.

FIG. 4 shows the use of the present device as a single forward spring line to prevent rearward movement of the boat in its mooring. Specifically, loop 18 is secured by cleat 26 and free end 14 and/or 16 are secured by a pier cleat.

Figure 5:
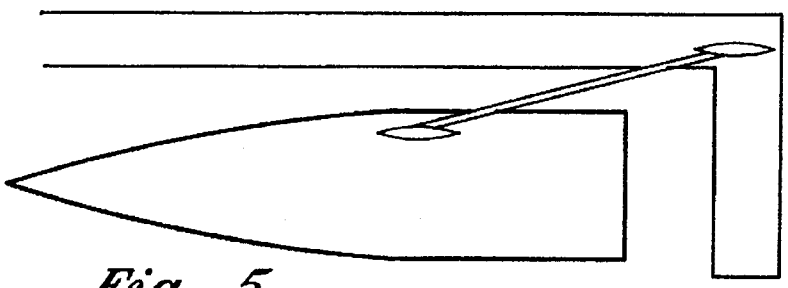
FIG. 5 shows a schematic diagram, representative of an alternate use of the present invention as an aft spring line, with a ship in top plan view.

FIG. 5 shows the use of the present invention 10 as an aft spring line to prevent forward motion of the boat in its mooring. Specifically, loop 18 is secured by cleat 26 and free end 14 and/or 16 is secured by a pier cleat.

With the use of the present invention, which forms a threeway spring line, a complete spring line is eliminated, which greatly reduces cost and allows for much easier manipulation for securing and unsecuring the boat from the pier, while not reducing the effectiveness of the spring line.

Although the present invention is shown using a strand-twisted nylon for the spring line, the materials for the line or rope can be made from other synthetic or natural fibers provided the material is capable of being woven without compromising the strength of the material.

Furthermore, the instant invention may be formed having loops formed by ends 14 and 16, as well a central loop 18.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved spring line for a marine vessel for securing a vessel to a pier or dock structure comprising:

a line, said line having a first, elongated section with a first free end, a second, elongated section with a second free end, said first and second elongated sections being unitarily continuously connected together; and an enlarged loop segment formed by said line and disposed between said first line end and said second line end, forming a segment of said line, said loop segment being integrally connected and formed integrally and connected with said first and second line sections, forming a continuous line that includes said first line section, said loop segment, and said second line section, said loop segment including two interwoven connection junction locations that are integrally woven into said line continuous from said first free end to said second free end, said junction locations define a short line segment disposed between said loop segment and said line, wherein an extremely strong structure is formed and said loop segment cannot separate from said line.

2. An improved spring line as in claim 1, wherein said first free end defines a loop.

3. An improved spring line as in claim 1, wherein said second free end defines a loop.

4. An improved spring line as in claim 1, wherein said loop diameter is at least greater than 6 inches.

5. An improved spring line as in claim 1, wherein said line is sized between ⅜ inches and ⅝ inches in diameter.

6. An improved spring line as in claim 1, wherein said line is constructed of synthetic fibers.

* * * * *